US007486182B2

(12) United States Patent
Hahn et al.

(10) Patent No.: US 7,486,182 B2
(45) Date of Patent: Feb. 3, 2009

(54) ELECTRONIC INTERMEDIATE MODULE

(75) Inventors: Ulrich Hahn, Fürth (DE); Udo Ollert, Kirchweidach (DE); Michael Spingler, Herzogenaurach (DE); Erich Strasser, Trostberg (DE)

(73) Assignee: Dr. Johannes Heidenhain GmbH, Traunreut (DE)

( * ) Notice: Subject to any disclaimer, the term of this patent is extended or adjusted under 35 U.S.C. 154(b) by 117 days.

(21) Appl. No.: 10/545,212

(22) PCT Filed: Jan. 16, 2004

(86) PCT No.: PCT/EP2004/000288

§ 371 (c)(1),
(2), (4) Date: Feb. 21, 2006

(87) PCT Pub. No.: WO2004/072923

PCT Pub. Date: Aug. 26, 2004

(65) Prior Publication Data

US 2006/0170544 A1 Aug. 3, 2006

(30) Foreign Application Priority Data

Feb. 14, 2003 (DE) ..... 103 06 231

(51) Int. Cl.
*G08B 29/00* (2006.01)

(52) U.S. Cl. ..... 340/506; 340/517; 340/521

(58) Field of Classification Search ..... 340/506, 340/517, 521, 835.36, 825.49, 539.1, 539.33, 340/825.36

See application file for complete search history.

(56) References Cited

U.S. PATENT DOCUMENTS

| | | | | |
|---|---|---|---|---|
| 5,687,103 | A | 11/1997 | Hagl et al. | |
| 5,959,529 | A * | 9/1999 | Kail, IV | 340/539.12 |
| 6,031,455 | A * | 2/2000 | Grube et al. | 340/539.26 |
| 6,633,782 | B1 | 10/2003 | Schleiss et al. | |
| 6,940,403 | B2 * | 9/2005 | Kail, IV | 340/539.12 |
| 2003/0006915 | A1 | 1/2003 | Kauppila et al. | |

FOREIGN PATENT DOCUMENTS

| | | | |
|---|---|---|---|
| CA | 2 315 459 | A1 | 9/2002 |
| DE | 37 43 847 | A1 | 7/1989 |
| DE | 195 08 834 | C2 | 12/1996 |
| DE | 195 16 938 | C1 | 12/1996 |
| DE | 197 32 713 | A1 | 2/1999 |
| DE | 100 07 971 | A1 | 10/2000 |
| DE | 100 54 095 | A1 | 5/2002 |
| JP | 11-223558 | A | 8/1999 |
| WO | WO 01/65228 | A1 | 9/2001 |

* cited by examiner

*Primary Examiner*—Daryl C Pope
(74) *Attorney, Agent, or Firm*—Brinks Hofer Gilson & Lione

(57) ABSTRACT

An electronic intermediate module for acquiring data from at least one peripheral unit, and for transmitting the acquired data to a position measuring device, the electronic intermediate module including a data acquisition interface for a data transmission connection which is designed for transmitting first data from the peripheral unit in a direction toward the electronic intermediate module. The electronic intermediate module further including a communications interface for a communications connection, wherein the communications connection is designed for transmitting second data from the intermediate module to the position measuring device.

16 Claims, 1 Drawing Sheet

ELECTRONIC INTERMEDIATE MODULE

Applicants claim, under 35 U.S.C. §§ 120 and 365, the benefit of priority of the filing date of Jan. 16, 2004 of a Patent Cooperation Treaty patent application, copy attached, Ser. No. PCT/EP2004/000288, filed on the aforementioned date, the entire contents of which are incorporated herein by reference, wherein Patent Cooperation Treaty patent application Ser. No. PCT/EP2004/000288 was not published under PCT Article 21(2) in English.

Applicants claim, under 35 U.S.C. § 119, the benefit of priority of the filing date of Feb. 14, 2003 of a German patent application, copy attached, Ser. No. 103 06 231.9, filed on the aforementioned date, the entire contents of which are incorporated herein by reference.

BACKGROUND OF THE INVENTION

Field of the Invention

The present invention relates to an electronic intermediate module for acquiring data from at least one peripheral unit and for transmitting the acquired data to a position measuring device.

Description of the Related Art

It is known from JP 11-223558 to transmit the measured values from a temperature sensor which, for example, measures the temperature of an electrical drive mechanism, to a position measuring device, and to transmit the position data, together with the temperature data, in serial form to a downstream located control unit via an appropriate communications connection. For this purpose, the measured data from the temperature sensor are A/D converted in the position measuring device and are suitably processed for the serial transmission. In connection with such a configuration it is considered to be problematic in that possibly interfering effects from the temperature sensor on the electronics of the position measuring device, and therefore erroneous position data, result from it.

Further problems arise if, in addition to the data from the temperature sensor, still further data from other peripheral units are to be transmitted via the serial communications connection to the position measuring device, and thereafter to a downstream located control unit, for example the data from acceleration sensors, etc. Thus, in case of several such peripheral units, the problem arises that the respective position measuring device then must have a corresponding plurality of interfaces, plug connections, etc., for the further peripheral units.

SUMMARY AND OBJECTS OF THE INVENTION

It is therefore an object of the present invention to disclose a solution which the transmission of data from different peripheral units via a serial communications connection between a position measuring device and a control unit can be provided as interference-free as possible and with little outlay.

This object is attained by an electronic intermediate module for acciuiring data from at least one peripheral unit, and for transmitting the acquired data to a position measuring device, the electronic intermediate module including a data acquisition interface for a data transmission connection which is designed for transmitting first data from the peripheral unit in a direction toward the electronic intermediate module. The electronic intermediate module further including a communications interface for a communications connection, wherein the communications connection is designed for transmitting second data from the intermediate module to the position measuring device.

In accordance with the present invention its has now been provided to arrange an electronic intermediate module between the position measuring device and the at least one peripheral unit, which is designed in a defined manner. Thus, the intermediate module includes one or several data acquisition interfaces, through which the transmission of data from one or several peripheral units takes place in the direction of the intermediate module. Furthermore, a communications interface for a communications connection is provided in the intermediate module, which preferably is embodied for the serial transmission of data from the intermediate module to the position measuring device.

In this case, the data acquisition interfaces in the intermediate module can be provided for the transmission of analog data, as well as for the serial transmission of data between the intermediate module and the peripheral units, depending on what type of peripheral units are intended to be used.

The provision of intermediate modules designed in this way offers a number of advantages. For one, the decoupling between the at least one peripheral unit and the electronics of the position measuring device is assured, so that interfering effects, in particular on the part of the electronics, no longer result. Moreover, on the part of the position measuring device it is only necessary to make a single interface available for communications with the intermediate module, regardless of the number and type of possible peripheral units, therefore the wiring outlay is correspondingly reduced, even in the case of several peripheral units employed, whose data are to be transmitted in the direction toward a downstream located control unit. In addition, the most diverse peripheral units, which respectively provide data which are not time-critical and are in the end transmitted to the downstream located control unit, can be connected via the intermediate module in accordance with the invention to the position measuring device. Besides most diverse sensors—for example suited for temperature measurements—such peripheral units can moreover also be memory units, etc. which, for example contain arrangement-specific data.

Further advantages of the present invention ensue from the following description of an exemplary embodiment by the attached drawing.

DESCRIPTION OF THE PREFERRED EMBODIMENT(S) OF THE INVENTION

Figure 1:
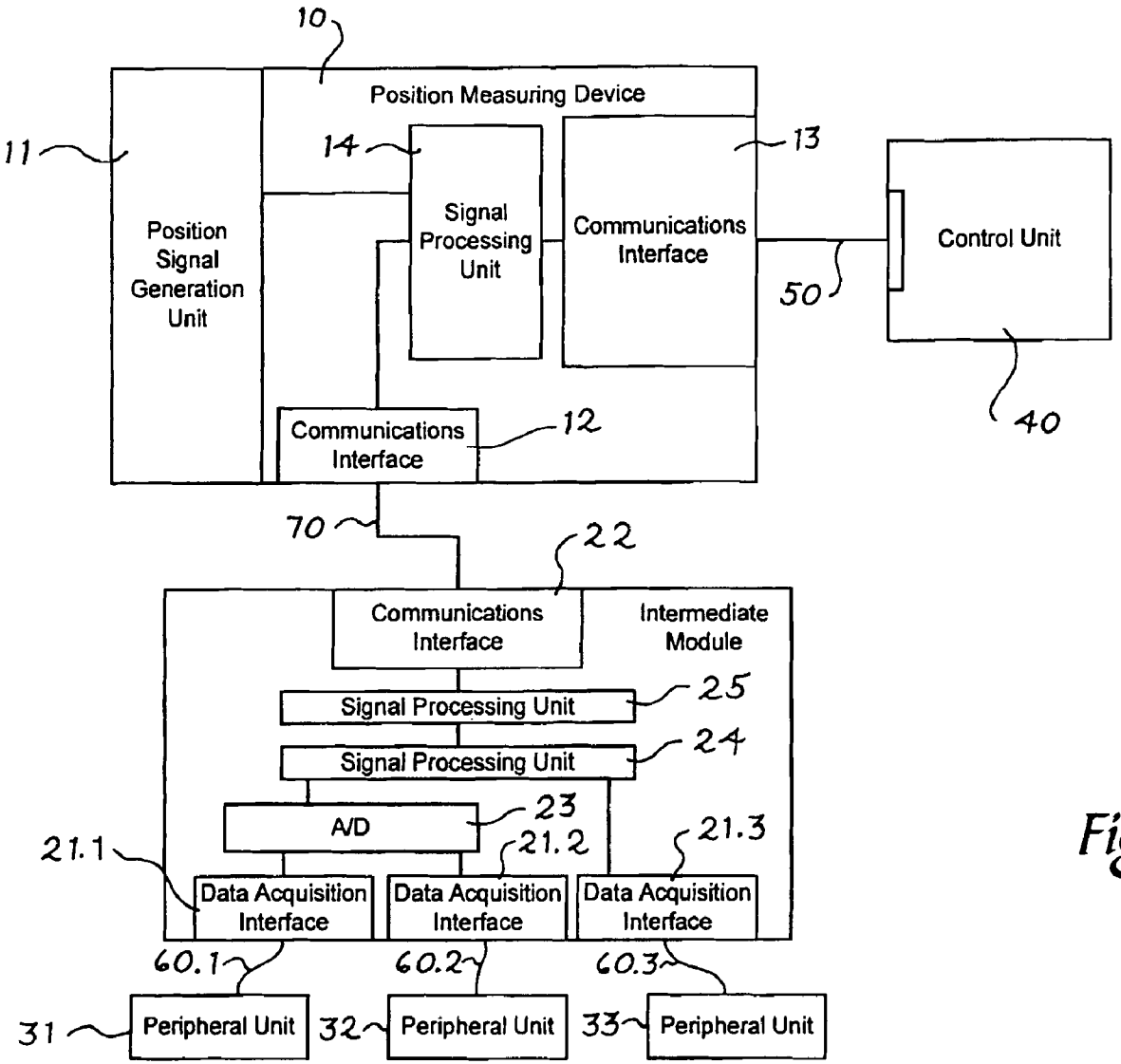
FIG. 1 schematically shows an embodiment of a position measuring device that employs an embodiment of an intermediate module in accordance with the present invention.

FIG. 1 shows a schematic block diagram of an arrangement including a position measuring device 10, an intermediate module 20 in accordance with the present invention, several peripheral units 31, 32, 33, and a control unit 40. Such an arrangement can be provided in a machine tool, for example, wherein the position of a movable element, which is positioned by means of a—not represented—electrical drive mechanism, is determined by the position measuring device 10. For regulating purposes, the position data detected in this way are transmitted to a downstream located control unit 40 in the form of a numeric machine tool control.

In such an embodiment variation, a first temperature sensor 31, a second temperature sensor 32 and a memory unit 33, for example, function as the peripheral units 31, 32, 33. Different temperatures are detected by the temperature sensors 31, 32, for example the winding temperature of the electrical drive mechanism, etc., and the data, or measured values, detected by means of these peripheral units 31, 32 are further processed in a known manner for control and regulating purposes by the control unit 40, following their—still to be explained—transmission.

The third peripheral unit 33 also provided in this example is embodied as a memory unit, which is, for example, arranged on the side of the drive mechanism remote from the position measuring device 10 and contains arrangement-specific data, which are also further processed by the control unit 40. Such arrangement-specific data can be, for example, characteristic motor data, etc., which are used for the automatic start-up of the total system.

Therefore, in principle the different peripheral units can be sensors which are essentially embodied for detecting measured values which are not time-critical, and are then further processed in the control unit. As explained, the employment of read-in and read-out memory units as peripheral units is alternatively also possible at this location. Moreover, still further variations of peripheral units can of course also be employed at this location.

Instead of feeding the data from such peripheral units 31, 32, 33 directly to the position measuring device 10 as was previously done, and transmitting the data via the serial communications connection 50 to the control unit 40, the employment in accordance with the present invention of the electronic intermediate module is now provided. As can be seen from the drawing, it is first supplied with the data from the at least one peripheral unit 31, 32, 33 before these data are transmitted to the position measuring device 10.

As can be further seen from the representation in the drawing, in the present example the intermediate module 20 includes for this purpose three schematically indicated data acquisition interfaces 21.1, 21.2, 21.3, or data acquisition inputs for three data transmission connections 60.1, 60.2, 60.3 to the peripheral units 31, 32, 33. In this case the data transmission connections 60.1, 60.2, 60.3 are each designed for the transmission of data between the respective peripheral unit 31, 32, 33 and the intermediate module 20. Depending on the type of the peripheral unit 31, 32, 33, data transmission between the peripheral unit 31, 32, 33 and the intermediate module can vary, and in that case the interfaces 21.1, 21.2, 21.3 must of course also be differently designed accordingly. Thus, for example in the case of the peripheral units 31, 32 embodied as temperature and acceleration sensors, the created measured values are transmitted as analog data to the intermediate module 20, and the associated data acquisition interfaces 21.1, 21.2 must accordingly be designed in such a way that the transmission of analog data between the peripheral units 31, 32 and the intermediate module 20 is possible. However, in the case of the third peripheral unit 33 in this example designed as a memory unit, a serial transmission of data between the memory unit 33 and the intermediate module 20 is provided, accordingly, the data acquisition interface 21.3 must be embodied in such a way that a serial data transmission between the memory unit 33 and the intermediate module 20 is possible.

The data transmitted in this way to the intermediate module 20 are subsequently further processed—in a manner still to be explained—in the intermediate module 20 and are made available at the output for transmission via the first serial communications connection 70 to the position measuring device 10. To this end, the intermediate module 20 in accordance with the present invention has a communications interface 22 for the first communications connection 70, via which a serial transmission of data between the intermediate module 20 and the position measuring device 10 takes place.

For this purpose, a first communications interface 12 for the first, preferably serial communications connection 70 for the intermediate module 20 is provided on the side of the position measuring device 10. The position measuring device 10 furthermore has a second communications interface 13 for a second, also preferably serial communications connection 50, via which the data transmission between the position measuring device 10 and the downstream located control unit 40 is performed.

Accordingly, the data from the various peripheral units 31, 32, 33 which are not time-critical and were transmitted by the intermediate module, together with the position data generated by means of a position signal generation unit 11, are processed in a signal processing unit 14 in such a way that they can be transmitted to the control unit 40 in a suitable serial protocol via the second communications connection 50.

A number of further components in an intermediate module 20 in accordance with the present invention is indicated in a schematic form between the data acquisition interfaces 21.1, 21.2, 21.3 and the communications interface 22, whose basic functions will be explained in what follows. It should be pointed out at this time that the type, number and design of these components can easily be varied in accordance with the peripheral units to be connected.

Thus, in the present example the intermediate module 20 furthermore contains an A/D conversion unit 23, which is used for digitizing the analog data provided by the two peripheral units 31, 32.

A first signal processing unit 24 is furthermore provided in the intermediate module 20 for further processing of the data from the peripheral units 31, 32, 33, which in this example are in digitized form. It is for example possible by this to provide suitable processing of the measured values of the two peripheral units 31, 32, which here can be in the form of suitable filtering of the temperature data provided, signal monitoring, including the generation of alarms, etc.

A second signal processing unit 25 on the side of the intermediate module is also indicated in schematic form in the drawing, which substantially sees to the processing of the data provided by or transmitted from the peripheral units 31, 32, 33 for serial transmission via the communications interface 22.

In the case of the first serial communications connection 70 between the intermediate module 20 in accordance with the present invention and the position measuring device this can be, for example, a so-called $I^2C$ interface. Incidentally, the same interface architecture can also be advantageously provided in the case of the serial data transmission connection 60.3 between the intermediate module 20 and the peripheral unit 33 embodied as a memory unit. However, in principle other known serial interface architectures can be employed at this location.

The second serial communications connection 50 between the position measuring device 10 and the downstream located control unit 40 can be, for example, an interface architecture on the basis of an ethernet, via which the data transfer is performed. In principle, other known serial interface architectures can be considered at this location.

Alternatively to the arrangement includes a position measuring device, the intermediate module and the control unit, basically other arrangement variations also exist. It would for example also be possible to arrange the intermediate module between the control unit and the position measuring device.

The data delivered by the peripheral units are initially transmitted to the intermediate module via the data acquisition interfaces of the intermediate module and then via the communications interface to the position measuring device. There the data are processed, together with the position data, for the serial transmission to the control unit and are finally transmitted via the intermediate module to the control unit. In this case it would furthermore be conceivable to house a voltage supply for the position measuring device in the intermediate module.

Thus, besides the explained exemplary embodiment, many further design possibilities exist within the scope of the present invention.

We claim:

1. An arrangement for regulating an electrical drive, the arrangement comprising:

a peripheral unit;

an electronic intermediate module connected to said peripheral unit via a data acquisition interface and a data transmission connection;

a position measuring device that provides position data of a movable element for regulating purposes, said position measuring device is connected with said electronic intermediate module via a first communications interface and a first serial communications connection, wherein first data which is not time critical is transmitted from said peripheral unit to said electronic intermediate module via said data transmission connection and second data which is not time critical is transmitted from said electronic intermediate module to said position measuring device via said first serial communications connection, wherein said position measuring device further comprises a second communications interface; and a control unit being connected to said position measuring device via said second communications interface and a second serial communications connection via which said position data and said second data is transmitted and wherein said control unit uses said position data and said second data for regulating said electrical drive.

2. The arrangement in accordance with claim 1, wherein said first data comprises analog data and said data acquisition interface is designed for transmitting said analog data between said peripheral unit and said intermediate module.

3. The arrangement in accordance with claim 2, wherein said electronic module further comprises an A/D conversion unit for digitizing said analog data transmitted from said peripheral unit.

4. The arranaement in accordance with claim 1, wherein said electronic module further comprises a signal processing unit for processing said first data transmitted from said peripheral unit.

5. The arrangement in accordance with claim 1, wherein said electronic module further comprises a signal processing unit, which is suited for processing said first data transmitted from said peripheral units for serial transmission via said communications interface.

6. The arrangement in accordance with claim 1, wherein said data acquisition interface is designed for serial transmission of data between said peripheral unit and said intermediate module.

7. The arrangement in accordance with claim 1, wherein said communications interface is designed for serial transmission of data via said first communications connection.

8. The arrangement in accordance with claim 1, wherein said first data is processed by said electronic intermediate module into said second data which is different than said first data.

9. The arrangement in accordance with claim 1, wherein said peripheral unit comprises a sensor for detecting measured values which are not time-critical.

10. The arrangement in accordance with claim 9, wherein said peripheral unit comprises a temperature sensor.

11. The arrangement in accordance with claim 9, wherein said peripheral unit comprises a memory unit.

12. The arrangement in accordance with claim 11, wherein specific data regarding said position measuring arrangement are stored in said memory unit.

13. The arrangement in accordance with claim 1, wherein said electronic intermediate module comprises a plurality of data acquisition interfaces.

14. The arrangement in accordance with claim 13, wherein said plurality of data acquisition interfaces are distinct from each other.

15. The arrangement in accordance with claim 1, further comprising a temperature sensor that detects a winding temperature of said electrical drive.

16. The arrangement in accordance with claim 1, wherein said peripheral unit comprises an acceleration sensor.

* * * * *

UNITED STATES PATENT AND TRADEMARK OFFICE

CERTIFICATE OF CORRECTION

PATENT NO. : 7,486,182 B2
APPLICATION NO. : 10/545212
DATED : February 3, 2009
INVENTOR(S) : Ulrich Hahn et al.

It is certified that error appears in the above-identified patent and that said Letters Patent is hereby corrected as shown below:

In column 6, claim 4, line 5, replace "The arranaement" with --The arrangement--.

Signed and Sealed this

Tenth Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,486,182 B2
APPLICATION NO. : 10/545212
DATED : February 3, 2009
INVENTOR(S) : Ulrich Hahn et al.

It is certified that error appears in the above-identified patent and that said Letters Patent is hereby corrected as shown below:

On the Title Page

In column 1, item (73), after "Traunreut (DE)" insert --; Siemens AG, Munich (DE)--.

Signed and Sealed this
Twentieth Day of September, 2011

David J. Kappos

David J. Kappos
*Director of the United States Patent and Trademark Office*